US007530887B2

(12) United States Patent
Jiang et al.

(10) Patent No.: US 7,530,887 B2
(45) Date of Patent: May 12, 2009

(54) CHEMICAL MECHANICAL POLISHING PAD WITH CONTROLLED WETTING

(75) Inventors: Bo Jiang, Newark, DE (US); Gregory P. Muldowney, Earleville, MD (US); Ravichandra V. Palaparthi, Newark, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/839,874

(22) Filed: Aug. 16, 2007

(65) Prior Publication Data

US 2009/0047876 A1 Feb. 19, 2009

(51) Int. Cl.
*B24D 11/00* (2006.01)

(52) U.S. Cl. ..... 451/527; 451/41

(58) Field of Classification Search ..... 451/41, 451/28, 526–539

See application file for complete search history.

(56) References Cited

U.S. PATENT DOCUMENTS

| | | | | |
|---|---|---|---|---|
| 5,578,362 | A | 11/1996 | Reinhardt et al. | |
| 6,103,376 | A | 8/2000 | Phillips et al. | |
| 6,477,926 | B1 * | 11/2002 | Swisher et al. | 451/526 |
| 6,533,645 | B2 * | 3/2003 | Tolles | 451/41 |
| 6,610,903 | B1 | 8/2003 | Latimer et al. | |
| 6,896,593 | B2 * | 5/2005 | Prasad | 451/41 |
| 2006/0052040 | A1 | 3/2006 | Prasad | |
| 2007/0190909 | A1 | 8/2007 | Muldowney | |
| 2007/0190916 | A1 | 8/2007 | Muldowney | |

OTHER PUBLICATIONS

U.S. Appl. No. 11/893,495, Muldowney.
U.S. Appl. No. 11/893,785, Jiang et al.
Oner, et al., Ultrahydrophobic Surfaces. Effects of Topography Length Scales on Wettability, Langmuir vol. 16, No. 20, pp. 7777-7782 (2000).
Ghassemzadeh, et al., Pore network simulation of imbibition into paper during coating: I. model development, Aiche Journal vol. 47, No. 3, pp. 519 535 (Mar. 2001).
Lundgren, et al., Molecular dynamics study of wetting of a pillar surface, Langmuir vol. 19, No. 17, pp. 7127-7129 (2003).
He, et al., Multiple equilibrium droplet shapes and design criterion for rough hydrophobic surfaces, Langmuir vol. 19, No. 12, pp. 4999-5003 (2003).
Patankar, Neelesh A., On the modeling of hydrophobic contact angles on rough surfaces, Langmuir vol. 19, No. 4, pp. 1249-1253 (2003).
Ghassemzadeh, et al., Pore network simulation of fluid imbibition into paper during coating: Chemical Engineering Science 59, pp. 2265-2280 (2004).
Ebert, et al., Influence of inorganic fillers on the compaction behaviour of porous polymer based membranes . . . , J. Membrane Science 233, pp. 71-78 (2004).
Staff Writer, Moving through paper, Future Materials News (Jul. 2004).

(Continued)

*Primary Examiner*—Dung Van Nguyen
(74) *Attorney, Agent, or Firm*—Thomas S. Deibert

(57) ABSTRACT

Chemical mechanical polishing pads are provided, wherein the chemical mechanical polishing pads have a polishing layer comprising a polishing texture that exhibits a dimensionless roughness, R, is between 0.01 and 0.75. Also provided are methods of making the chemical mechanical polishing pads and for using them to polish substrates.

10 Claims, 6 Drawing Sheets

OTHER PUBLICATIONS

Unsal, et al., Effect of liquid characteristics on the wetting, capillary migration, and retention properties . . . J. Applied Polymer Science, vol. 97, pp. 282-292 (2005).

Martines, et al., Superhydrophibicity and superhydrophilicity of regular nanopatterns, Nano Letters, vol. 5, No. 10, pp. 2097-2103 (2005).

Piri, et al., Three-dimensional mixed-wet random pore-scale network modeling Physical Review E, vol. 71, No. 2, pp. 026301-1 to -30 (Feb. 2005).

Li, et al., What do we need for a superhydrophobic surface? A review of the recent progress Chemical Society Reviews, 36, pp. 1350-1368 (2007).

* cited by examiner

CHEMICAL MECHANICAL POLISHING PAD WITH CONTROLLED WETTING

The present invention relates generally to the field of polishing pads for chemical mechanical polishing. In particular, the present invention is directed to a chemical mechanical polishing pad having a polishing structure useful for chemical mechanical polishing magnetic, optical and semiconductor substrates.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

The interaction among polishing layers, polishing media and wafer surfaces during CMP has been the subject of increasing study, analysis, and advanced numerical modeling in the past ten years in an effort to optimize polishing pad designs. Most of the polishing pad developments since the inception of CMP as a semiconductor manufacturing process have been empirical in nature, involving trials of many different porous and non-porous polymeric materials. Much of the design of polishing surfaces, or layers, has focused on providing these layers with various microstructures, or patterns of void areas and solid areas, and macrostructures, or arrangements of surface perforations or grooves, that are claimed to increase polishing rate, improve polishing uniformity, or reduce polishing defects (scratches, pits, delaminated regions, and other surface or sub-surface damage). Over the years, quite a few different microstructures and macrostructures have been proposed to enhance CMP performance.

For conventional polishing pads, pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". The origin of glazing is plastic flow of the polymeric material due to frictional heating and shear at the points of contact between the pad and the workpiece. Additionally, debris from the CMP process can clog the surface voids as well as the micro-channels through which slurry flows across the polishing surface. When this occurs, the polishing rate of the CMP process decreases, and this can result in non-uniform polishing between wafers or within a wafer. Conditioning creates a new texture on the polishing surface useful for maintaining the desired polishing rate and uniformity in the CMP process.

Conventional polishing pad conditioning is achieved by abrading the polishing surface mechanically with a conditioning disk. The conditioning disk has a rough conditioning surface typically comprised of imbedded diamond points. The conditioning disk is brought into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated. The conditioning process as described cuts microscopic furrows into the pad surface, both abrading and plowing the pad material and renewing the polishing texture.

Although pad designers have produced various microstructures and configurations of surface texture through both pad material preparation and surface conditioning, existing CMP pad polishing textures are less than optimal. The actual contact area between a conventional CMP pad and a typical workpiece under the applied pressures practiced in CMP is small—usually only a few percent of the total confronting area. This is a direct consequence of the inexactness of conventional surface conditioning that amounts to randomly tearing the solid regions of the structure into tatters, leaving a population of features, or asperities, of various shapes and heights of which only the tallest actually contact the workpiece. Thus conventional pad microstructures are not optimal.

Defect formation in CMP has origins in the non-optimization of conventional pad microstructure. For example, Reinhardt et al., in U.S. Pat. No. 5,578,362, disclose the use of polymeric spheres to introduce texture into a polyurethane polishing pad. Although exact defect formation mechanisms are incompletely understood, it is generally clear that reducing defect formation requires minimizing extreme point stresses on the workpiece. Under a given applied load or polish pressure, the actual point contact pressure is inversely proportional to the true contact area. A CMP process running at 3 psi (20.7 kPa) polish pressure and having 2% real contact area across all asperity tips actually subjects the workpiece to normal stresses averaging 150 psi (1 MPa). Stresses of this magnitude are sufficient to cause surface and sub-surface damage.

Beyond providing potential defect formation sources, conventional polishing pad microtexture is not optimal because pad surface conditioning is typically not exactly reproducible. The diamonds on a conditioning disk become dulled with use such that the conditioner must be replaced after a period of time; during its life the effectiveness of the conditioner thus continually changes. Conditioning also contributes greatly to the wear rate of a CMP pad. It is common for about 95% of the wear of a pad to result from the abrasion of the diamond conditioner and only about 5% from contact with workpieces. Thus in addition to defect reduction, improved pad microstructure could eliminate the need for conditioning and allow longer pad life.

The key to eliminating pad conditioning is to devise a polishing surface that is self-renewing, that is, that retains the same essential geometry and configuration as it wears. Thus to be self-renewing, the polishing surface must be such that wear does not significantly reshape the solid regions. This in turn requires that the solid regions not be subjected to continuous shear and heating sufficient to cause a substantial degree of plastic flow, or that the solid regions be configured so that they respond to shear or heating in a way that distributes the shear and heating to other solid regions.

In addition to low defectivity, CMP pad polishing structures must achieve good planarization efficiency. Conventional pad materials require a trade-off between these two performance metrics because lower defectivity is achieved by making the material softer and more compliant, yet these same property changes compromise planarization efficiency. Ultimately, planarization requires a stiff flat material; while low defectivity requires a less stiff conformal material. It is thus difficult to surmount the essential trade-off between these metrics with a single material. Conventional pad structures approach this problem in a variety of ways, including the use of composite materials having hard and soft layers bonded to one another. While composites offer improvements over single-layer structures, no material has yet been developed that achieves ideal planarization efficiency and zero defect formation simultaneously.

Consequently, while pad microstructure and conditioning means exist for contemporary CMP applications, there is a need for CMP pad designs that achieve higher real contact area with the workpiece, as well as reducing or eliminating the need for re-texturing. In addition, there is a need for CMP pad structures that combine a rigid stiff structure needed for good planarization efficiency with a less stiff conformal structure needed for low defectivity. Also, in some chemical mechanical polishing operations, it would be desirable to have a chemical mechanical polishing pad with a polishing surface that is non-wetted by the polishing medium. Specifically, for these polishing operations, it would be desirable to have a polishing pad with a textured surface that is superhydrophobic such that the polishing debris generated during polishing are mostly removed from the polishing surface of the polishing pad before they can foul the polishing surface; thus, reducing the need for periodic conditioning of the polishing surface.

In one aspect of the present invention, there is provided a chemical mechanical polishing pad for polishing a substrate selected from at least one of a magnetic substrate, an optical substrate and a semiconductor substrate; comprising: a polishing layer comprising a plurality of polishing elements forming a three-dimensional reticulated network having a polishing texture; wherein the polishing texture comprises a plurality of contact areas on a subset of the polishing elements; wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area; wherein the average dimensionless roughness of the polishing texture is between 0.01 and 0.75; and, wherein the polishing texture is adapted for polishing the substrate.

In another aspect of the present invention, there is provided a method for polishing a substrate, comprising: providing a substrate selected from at least one of a magnetic substrate, an optical substrate and a semiconductor substrate; providing a chemical mechanical polishing pad having a polishing layer comprising a plurality of polishing elements forming a three-dimensional reticulated network having a polishing texture; wherein the polishing texture comprises a plurality of contact areas on the polishing elements; wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area; wherein the average dimensionless roughness for the polishing texture is between 0.01 and 0.75; and wherein the polishing texture is adapted for polishing the substrate; and, creating dynamic contact at the interface between the chemical mechanical polishing pad and the substrate.

DETAILED DESCRIPTION

Figure 1:
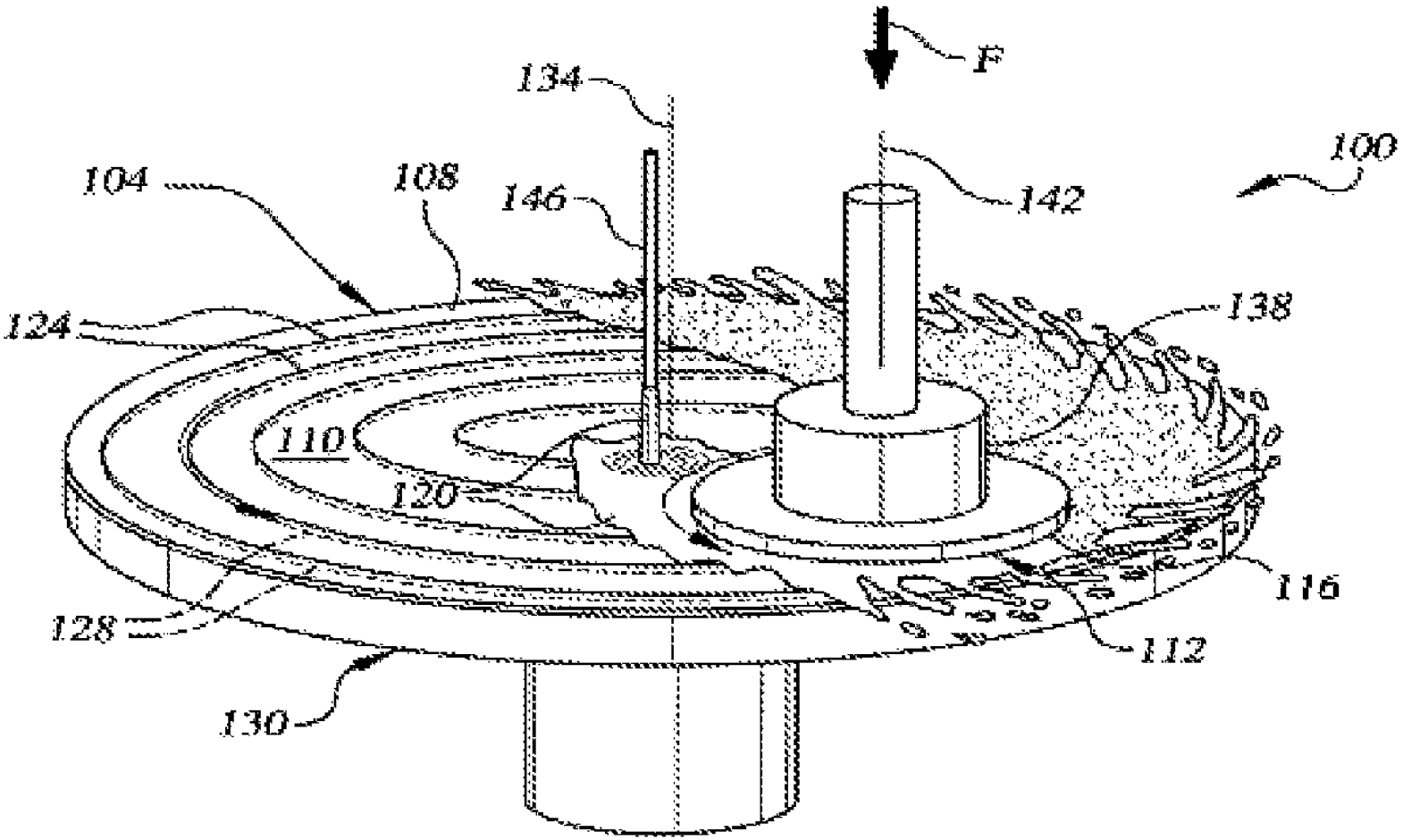
FIG. 1 is a perspective view of a portion of a dual-axis polisher suitable for use with the chemical mechanical polishing pads of the present invention.

The term "projected area" as used herein and in the appended claims refers to the total area in a horizontal plane parallel to the polishing surface of a chemical mechanical polishing pad that is occupied by a polishing element or subsection thereof. The projected area includes the area in the horizontal plane physically occupied by a polishing element (hereinafter referred to as the "contact area") and any empty space between that polishing element and any adjacent polishing elements in the horizontal plane.

The term "contact area" as used herein and in the appended claims refers to a subset of the total projected area of a polishing element in the horizontal plane that is physically occupied by that polishing element.

The term "non-contact area" as used herein and in the appended claims refers to the total surface area of a polishing element that is without the horizontal plane, for example, surfaces of the polishing element that are at an angle to the horizontal plane.

The term "fibrillar morphology" as used herein and in the appended claims refers to a morphology of a phase in which the phase domains have a three dimensional shape with one dimension much larger than the other two dimensions.

The term "polishing medium" as used herein and in the appended claims encompasses particle-containing polishing solutions and non-particle-containing solutions, such as abrasive-free and reactive-liquid polishing solutions.

The term "substantially circular" as used herein and in the appended claims in reference to the polishing elements means that the radius, r, of the cross section varies by ≦20% for the cross section.

The term "substantially circular cross section" as used herein and in the appended claims in reference to the polishing surface means that the radius, r, of the cross section from the central axis to the outer periphery of the polishing surface varies by ≦20% for the cross section. (See FIG. 6).

In some embodiments of the present invention, the chemical mechanical polishing pad comprises: a polishing layer comprising an interpenetrating network, wherein the interpenetrating network comprises a continuous non-fugitive phase and a substantially co-continuous fugitive phase; and wherein the polishing layer has a polishing surface adapted for polishing the substrate. In some aspects of these embodiments, the fugitive phase does not contain abrasive grains (e.g., cerium oxide, manganese oxide, silica, alumina, zirconia). In some aspects of these embodiments, the fugitive phase does not contain a pharmaceutical active. In some aspects of these embodiments, the fugitive phase does not contain an agricultural active (e.g., a fertilizer, insecticide, herbicide). In some aspects of these embodiment, the interpenetrating network is an interpenetrating polymer network.

In some embodiments of the present invention, the chemical mechanical polishing pads have a polishing texture that is adapted for polishing a substrate selected from a magnetic substrate, an optical substrate and a semiconductor substrate. In some aspects of these embodiments, the chemical mechanical polishing pads have a polishing texture that is adapted for polishing a substrate selected from a magnetic substrate. In some aspects of these embodiments, the chemical mechanical polishing pads have a polishing texture that is adapted for polishing a substrate selected from an optical substrate. In some aspects of these embodiments, the chemical mechanical polishing pads have a polishing texture that is adapted for polishing a substrate selected from a semiconductor substrate.

In some embodiments of the present invention, the chemical mechanical polishing pad comprises a polishing layer comprising a plurality of polishing elements forming a three-dimensional reticulated network having a polishing texture; wherein the polishing texture comprises a plurality of contact areas on a subset of the polishing elements; wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area; wherein the average dimensionless roughness of the polishing texture is between 0.01 and 0.75; and, wherein the polishing texture is adapted for polishing the substrate. In some aspects of these embodiments, the dimensionless roughness, R, of the polishing texture is between 0.03 and 0.50. In some aspects of these embodiments, the dimensionless roughness, R, of the polishing texture is between 0.06 and 0.25.

In some embodiments of the present invention, the chemical mechanical polishing pad comprises a polishing layer comprising a plurality of polishing elements forming a three-dimensional reticulated network having a polishing texture; wherein the polishing texture comprises a plurality of contact areas on a subset of the polishing elements; wherein ≧90% of the subset of polishing elements having contact areas exhibit a contact area that is within ±10% of the average contact area. In some aspects of these embodiments, ≧95% of the subset of polishing elements having contact areas exhibit a contact area that is within ±10% of the average contact area. In some aspects of these embodiments, ≧99% of the subset of polishing elements having contact areas exhibit a contact area that is within ±10% of the average contact area. In some aspects of these embodiments, ≧95% of the subset of polishing elements having contact areas exhibit a contact area that is within ±5% of the average contact area. In some aspects of these embodiments, ≧99% of the subset of polishing elements having contact areas exhibit a contact area that is within ±5% of the average contact area.

In some embodiments of the present invention, the chemical mechanical polishing pad comprises a polishing layer comprising a plurality of polishing elements forming a three-dimensional reticulated network having a polishing texture; wherein the polishing texture comprises a plurality of contact areas on a subset of the polishing elements; wherein ≧90% of the subset of polishing elements having contact areas exhibit a pitch with an adjacent polishing element having a contact area that is within ±10% of the average pitch. In some aspects of these embodiments, ≧95% of the subset of polishing elements having contact areas exhibit a pitch with an adjacent polishing element having a contact area that is within ±10% of the average pitch. In some aspects of these embodiments, ≧99% of the subset of polishing elements having contact areas exhibit a pitch with an adjacent polishing element having a contact area that is within ±10% of the average pitch. In some aspects of these embodiments, ≧95% of the subset of polishing elements having contact areas exhibit a pitch with an adjacent polishing element having a contact area that is within ±5% of the average pitch. In some aspects of these embodiments, ≧99% of the subset of polishing elements having contact areas exhibit a pitch with an adjacent polishing element having a contact area that is within ±5% of the average pitch.

In some embodiments of the present invention, the chemical mechanical polishing pad comprises a polishing layer comprising a plurality of polishing elements forming a three-dimensional reticulated network having a polishing texture; wherein the polishing texture comprises a plurality of contact areas on a subset of the polishing elements; wherein ≧90% of the subset of polishing elements having contact areas exhibit a contact area that is within ±10% of the average contact area and wherein ≧90% of the subset of polishing elements having contact areas exhibit a pitch with an adjacent polishing element having a contact area that is within ±10% of the average pitch. In some aspects of these embodiments, ≧95% of the subset of polishing elements having contact areas exhibit a contact area that is within ±10% of the average contact area and wherein ≧95% of the subset of polishing elements having contact areas exhibit a pitch with an adjacent polishing element having a contact area that is within ±10% of the average pitch. In some aspects of these embodiments, ≧95% of the subset of polishing elements having contact areas exhibit a contact area that is within ±10% of the average contact area and wherein ≧95% of the subset of polishing elements having contact areas exhibit a pitch with an adjacent polishing element having a contact area that is within ±10% of the average pitch. In some aspects of these embodiments, ≧99% of the subset of polishing elements having contact areas exhibit a contact area that is within ±5% of the average contact area and wherein ≧99% of the subset of polishing elements having contact areas exhibit a pitch with an adjacent polishing element having a contact area that is within ±5% of the average pitch.

In some embodiments of the present invention, the contact areas of the subset of polishing elements are selected from square cross-sections, rectangular cross-sections, rhomboid cross-sections, triangular cross-sections, circular cross-sections, ovoid cross-sections, hexagonal cross-sections, polygonal cross-sections, and irregular cross-sections.

In some embodiments of the present invention, selection of the shape(s) of the contact areas can be used to enhance the hydrophobicity of the polishing surface of the polishing pad. In some aspects of these embodiments, the shape(s) of the contact areas are selected to maximize the perimeter of the contact areas of the subset of polishing elements. It is believed that in some applications a larger contact area perimeter will provide a more hydrophobic polishing surface.

In some embodiments of the present invention, the reticulated network comprises a plurality of unit cells, wherein the plurality of unit cells have an average width and an average length, and wherein the average width of the unit cells is ≦ the average length of the unit cells. In some aspects of these embodiments, the average length of the unit cells is ≧ twice the average width of the unit cells. In some aspects of these embodiments, the average length of the unit cells is ≧ three times the average width of the unit cells. In some aspects of these embodiments, the average length of the unit cells is ≧ five times the average width of the unit cells. In some aspects of these embodiments, the average length of the unit cells is ≧ ten times the average width of the unit cells. In some aspects of these embodiments, the average length of the unit cells is ≧ twice and <15 times the average width of the unit cells. In some aspects of these embodiments, ≧90% of the unit cells have a width that is within ±10% of the average width and wherein ≧90% of the unit cells have a length that is within ±10% of the average length. In some aspects of these embodiments, ≧95% of the unit cells have a width that is within ±5% of the average width and wherein ≧95% of the unit cells have a length that is within ±5% of the average length.

In some embodiments of the present invention, the method for polishing a substrate comprises: providing a substrate selected from at least one of a magnetic substrate, an optical substrate and a semiconductor substrate; providing a chemical mechanical polishing pad having a polishing layer comprising a plurality of polishing elements forming a three-dimensional reticulated network having a polishing texture; wherein the polishing texture comprises a plurality of contact areas on the polishing elements; wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area; wherein the average dimensionless roughness for the polishing texture is between 0.01 and 0.75; and wherein the polishing texture is adapted for polishing the substrate; and, creating dynamic contact at the interface between the chemical mechanical polishing pad and the substrate. In some aspects of these embodiments, the method further comprises: providing a polishing medium at an interface between the polishing texture and the substrate. In some aspects of these embodiments, the polishing texture is designed to exhibit a sufficiently high average dimensionless roughness to limit the extent to which the polishing medium permeates the polishing layer to less than 10% of the height of the polishing layer. In some aspects of these embodiments, the polishing texture is designed to exhibit a sufficiently high average dimensionless roughness to limit the extent to which the polishing medium permeates the polishing layer to less than 5% of the height of the polishing layer. In some aspects of these embodiments, the polishing texture is designed to exhibit a sufficiently high average dimensionless roughness to limit the extent to which the polishing medium permeates the polishing layer to less than 2% of the height of the polishing layer. In some aspects of these embodiments, the polishing texture is designed to exhibit a sufficiently high average dimensionless roughness to limit the extent to which the polishing medium permeates the polishing layer to less than 1% of the height of the polishing layer.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 having a polishing surface 110 for confronting an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. Polishing medium 120 travels through optional spiral grooves 124 having a depth 128.

The present invention generally includes providing polishing layer 108 with a polishing texture 200 (FIG. 2) formed from a series of similar or identical macroscopic or microscopic slender elements interconnected in three dimensions to stiffen the network with respect to shear and bending. Preferably, the elements have microscopic dimensions to create a microtexture. These features will be shown to provide both higher real contact area between the pad and wafer and more favorable slurry flow patterns between the pad and wafer than are realized using conventional polishing pads, as well as providing a self-renewing structure that reduces the need for pad conditioning. In addition, these features will be shown to function in a way that imparts stiffness to the pad at the length scale required for good planarization efficiency while allowing compliance at the shorter length scales required for low defectivity.

Polisher 100 may include polishing pad 104 mounted on platen 130. Platen 130 is rotatable about a rotational axis 134 by a platen driver (not shown). Wafer 112 may be supported by a wafer carrier 138 that is rotatable about a rotational axis 142 parallel to, and spaced from, rotational axis 134 of platen 130. Wafer carrier 138 may feature a gimbaled linkage (not shown) that allows wafer 112 to assume an aspect very slightly non-parallel to polishing layer 108, in which case rotational axes 134, 142 may be very slightly askew. Wafer 112 includes polished surface 116 that faces polishing layer 108 and is planarized during polishing. Wafer carrier 138 may be supported by a carrier support assembly (not shown) adapted to rotate wafer 112 and provide a downward pressure F to press polished surface 116 against polishing layer 108 so that a desired pressure exists between the polished surface and the polishing layer during polishing. Polisher 100 may also include a polishing medium dispenser 146 for supplying polishing medium 120 to polishing layer 108.

As those ordinarily skilled in the art will appreciate, polisher 100 may include other components (not shown) such as a system controller, polishing medium storage and dispensing system, heating system, rinsing system and various controls for controlling various aspects of the polishing process, such as follows: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the pressure F applied between the wafer and polishing pad, and (4) controllers, actuators and selectors for controlling the location of rotational axis 142 of the wafer relative to rotational axis 134 of the pad, among others. Those skilled in the art will understand how these components are constructed and implemented such that a detailed explanation of them is not necessary for those skilled in the art to understand and practice the present invention.

During polishing, polishing pad 104 and wafer 112 are rotated about their respective rotational axes 134, 142 and polishing medium 120 is dispensed from polishing medium dispenser 146 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Pressure F is typically, but not necessarily, selected from a pressure of 0.1 psi to 15 psi (6.9 to 103 kPa) between wafer 112 and polishing pad 104. As those of ordinary skill in the art will recognize, it is possible to configure the polishing pad in a web format or into polishing pads having a diameter less than the diameter of the substrate being polished.

Figure 2:
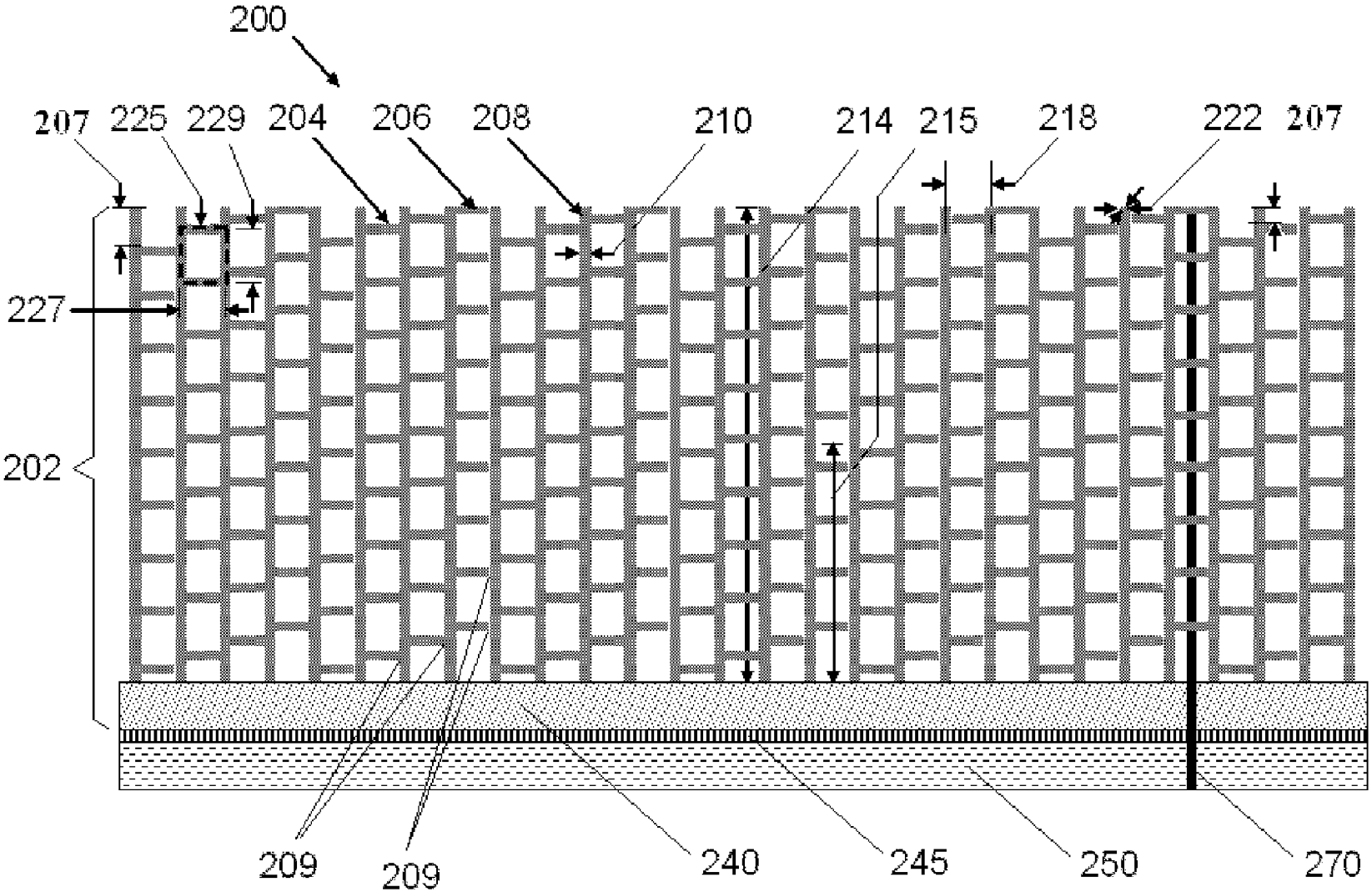
FIG. 2 is a highly enlarged, partial, schematic, cross-sectional, elevational view of a chemical mechanical polishing pad of one embodiment of the present invention.
Figure 3:
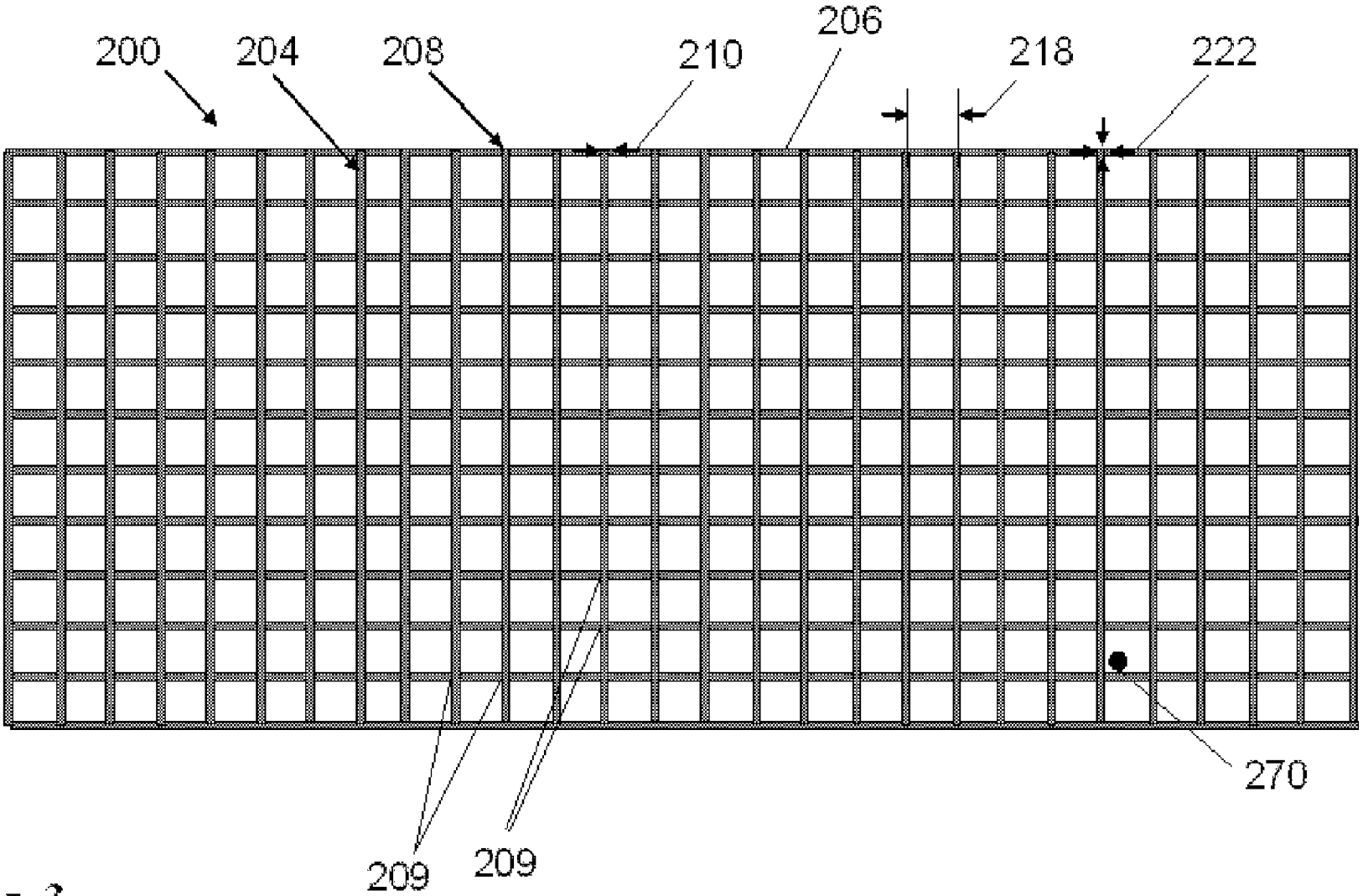
FIG. 3 is a highly enlarged, partial, schematic, plan view of the polishing pad of FIG. 2.

Referring now to FIGS. 2 and 3, embodiments of polishing pad 104 of FIG. 1 will be described in more detail, in particular relative to surface polishing texture 200. In contrast to conventional CMP pads in which surface texture or asperities are the residue of a material removal or reshaping process (i.e. conditioning), polishing texture 200 is built as a series of identical or similar polishing elements 204 and 208 having a precise geometry. For purposes of illustration, polishing texture 200 is shown to consist of substantially vertical elements 208 and substantially horizontal elements 204, but this need not be the case. Polishing texture 200 is tantamount to a multitude of such polishing elements 204 and 208 each having an average width 210 and an average contact area (i.e., cross-sectional area) 222, the elements being spaced at an average pitch 218. In addition, the interconnected network of elements 204, 208 has an average height 214 and average half-height 215. The polishing texture 200 is in effect a set of hexahedral unit cells, that is spatial units in which each face (of six) is a square or rectangle and solid members run along the edges only of the spatial unit, leaving the center of each face and of the spatial unit as a whole empty.

The average height 214 to average width 210 ratio of elements 208 is at least 0.5. Preferably the average height 214 to average width 210 ratio is at least 0.75 and most preferably at least 1. Optionally, the average height 214 to average width 210 ratio may be at least 5 or at least 10. As the average height increases, the number of interconnecting elements 204 required to stiffen the network of polishing elements 208 during polishing increases. In general, only the unconstrained ends of elements 208 projecting beyond the uppermost interconnecting elements 204 are free to flex under shear forces during polishing. The heights of elements 208 between the base layer 240 and the uppermost interconnecting element 204 are highly constrained and forces applied to any one element 208 are effectively carried by many adjacent elements 204 and 208, similar to a bridge truss or external buttressing. In this way polishing texture 200 is rigid at the length scale required for good planarization, but is locally compliant at shorter length scales by virtue of the local deformability and flexibility of the unbuttressed ends of elements 208.

The interconnecting elements 204 and polishing elements 208 combine to form a unit cell 225, the unit cell having an average width 227 and an average length 229. These unit cells have a reticulated or open-cell structure that combine to form the three-dimensional network. In some embodiments of the present invention, the polishing layer comprises an interconnected network with an average thickness of at least 3 unit cells; preferably at least 10 unit cells. Generally, increasing the height of the polishing layer (i.e., the thickness of the polishing layer) increases the life of the polishing pad as well as its bulk stiffness, the latter contributing to improved planarization.

In some embodiments of the present invention, the average width 227 of the unit cells is equal to or less than the average length 229 of the unit cells. In some aspects of these embodiments, the average length 229 of the unit cells is ≧ twice the average width 227 of the unit cells. In some aspects of these embodiments, the average length 229 of the unit cells is ≧ three times the average width 227 of the unit cells. In some aspects of these embodiments, the average length 229 of the unit cells is ≧ five times the average width 227 of the unit cells In some aspects of these embodiments, the average length 229 of the unit cells is ≧ ten times the average width 227 of the unit cells. In some aspects of these embodiments, the average length 229 of the unit cells is ≧ twice and <15 times the average width 227 of the unit cells.

In the embodiment shown in FIGS. 2 and 3, the contact area ratio C is the average contact area 222 divided by the unit projected area equal to the square of the pitch 218. The non-contact area used in the ratio N is the sum of three contributions: (a) the vertical surface of each upright element 208 over the individual height 207 by which such element extends above the uppermost interconnecting element 204, (b) the vertical surfaces of contact elements 206, and (c) the top horizontal area and side vertical areas of the uppermost interconnecting elements 204. It will be recognized that these non-contact areas are collectively the areas that are presented to a liquid encountering polishing texture 200 from above.

An advantage of the high average height to average width ratio of elements 208 is that the total polishing surface area of an average contact area (i.e., cross-sectional area) 222 remains constant for an extended period. As shown in FIG. 2, at any point in the life of polishing layer 202, while most of the contacting area of polishing texture 200 consists of the average contact areas (i.e., cross-sections) 222 of upright elements 208, all or part of some interconnecting elements 204 will also be in the process of wearing down, and these are designated in particular as contact elements 206. Preferably, the vertical positions of interconnecting elements 204 are staggered such that wear occurring parallel to the base layer 240 encounters only a small fraction of interconnecting elements 204 at any given point in time during polishing, and these contact elements 206 constitute a small fraction of the total contacting area. This allows polishing of several substrates with similar polishing characteristics and reduces or eliminates the need to periodically dress or condition the pad. This reduction in conditioning extends the pad's life and lowers its operating cost. Furthermore, optional perforations through the pad, the introduction of optional conductive-lined grooves or the incorporation of an optional conductor, such as conductive fibers, conductive network, metal grid or metal wire, can transform the pads into eCMP ("electrochemical mechanical planarization") polishing pads.

Optionally, it is possible to secure abrasive particles or fibers to polishing elements 204 and 208.

In some embodiments of the present invention, no void volume exists within individual elements 204 or 208; that is, all void volume in polishing texture 200 preferably exists between and distinctly outside polishing elements 204 and 208.

In some embodiments of the present invention, polishing elements 204 and 208 may have a hollow or porous structure.

In some embodiments of the present invention, polishing elements 208 are rigidly affixed at one end to a base layer 240 that maintains the pitch 218 and maintains polishing elements 208 in a substantially upright orientation. The orientation of elements 208 is further maintained by interconnecting elements 204 at junctions 209 that connect adjacent polishing elements 204 and 208. The junctions 209 may include an adhesive or chemical bond to secure elements 204 and 209. Preferably, junctions 209 represent an interconnection of the same materials and most preferably a seamless interconnection of the same materials.

It is preferred that width 210 and pitch 218 of the polishing elements 208 be uniform, or nearly so, across all polishing elements 208 from end to end between junctions 209, or uniform across subgroups of polishing elements 208. For example, preferably ≧95%, more preferably ≧99%, of polishing elements 208 have a width 210 and pitch 218 that remain within ±50% of the average width or pitch, respectively, in the polishing layer 202 between contact member 206 and half height 215. Still more preferably ≧95%, yet still more preferably ≧99%, of polishing elements 208 have a width 210 and pitch 218 that remain within ±20% of the average width or pitch, respectively, in the polishing layer 202 between contact member 206 and half height 215. Most preferably, ≧95% polishing elements 208 have a width 210 and pitch 218 that remain within ±10% of the average width or pitch, respectively, in the polishing layer 202 between contact member 206 and half height 215. In particular, maintaining cross-sectional area of polishing elements 204 and 208 between adjacent junctions 209 to within ±30% facilitates consistent polishing performance. Preferably, the pad maintains cross-sectional area to within ±20% and most preferably to within ±10% between adjacent junctions 209. Furthermore, polishing elements 204 and 208 preferably have a linear shape to further facilitate consistent polishing. A direct consequence of these features is that the average contact area (i.e., cross-sectional area) 222 of the polishing elements 208 does not vary considerably in the vertical direction. Thus as polishing elements 208 are worn during polishing and the height 214 decreases, there is little change in the contact area 222 presented to the wafer. This consistency in contact area 222 provides for a uniform polishing texture 200 and allows consistent polishing for repeated polishing operations. For example, the uniform structure allows polishing of multiple patterned wafers without adjusting the tool settings. For purposes of this specification, the polishing surface or texture 200 represents the surface area of polishing elements 204 and 208 measured in a plane parallel to the polishing surface. Preferably the total contact area 222 of polishing elements 208 remains within ±25% between the initial polishing surface or contact elements 206 and the half-height 215 of the vertical column of unit cells 225. Most preferably, the total contact area 222 of polishing elements 208 remains within 10% between the initial polishing surface and the half-height 215 of the vertical column of unit cells 225. As noted previously, it is further preferable that the vertical positions of interconnecting elements 204 are staggered to minimize the change in total cross sectional area as the elements wear down.

Optionally, it is possible to arrange polishing elements 208 in spaced groupings of several polishing elements 208—for example, the polishing elements may comprise circular groupings surrounded by areas free from polishing elements. Within each grouping, it is preferred that interconnecting elements 204 be present to maintain the spacing and effective stiffness of the groupings of elements 208. In addition, it is possible to adjust the density of the polishing elements 204 or 208 in different regions to fine tune removal rates and polishing or wafer uniformity. Furthermore, it is possible to arrange the polishing elements in a manner that forms optional open channels in the polishing texture 200, such as circular channels, X-Y channels, radial channels, curved-radial channels or spiral channels. The introduction of these optional channels may facilitate removal of large debris and may improve polishing or wafer uniformity.

It is preferable that height 214 of polishing elements 208 be uniform across all elements. It is preferred that height 214 remains within 20% of the average height, more preferably, remains within 10% of the average height, and even more preferably, remains within 1% of the average height within polishing texture 200. Optionally, a cutting device, such as a knife, high-speed rotary blade or laser may periodically cut the polishing elements to a uniform height. Furthermore, the diameter and speed of the cutting blade can optionally cut the polishing elements at an angle to alter the polishing surface. For example cutting polishing elements having a circular cross section at an angle will produce a texture of polishing tips that interact with the substrate. Uniformity of height ensures that all polishing elements 208 of polishing texture 200, as well as all interconnecting contact elements 206 in the plane of wear, have the potential to contact the workpiece. In fact, because industrial CMP tools have machinery to apply unequal polish pressure at different locations on the wafer, and because the fluid pressure generated under the wafer is sufficient to cause the wafer to depart from a position that is precisely horizontal and parallel to the average level of the pad, it is possible that some polishing elements 208 do not contact the wafer. However in any regions of polishing pad 104 where contact does occur, it is desired that as many polishing elements 208 as possible be of sufficient height to provide contact. Furthermore, since the unbutressed ends of polishing elements 208 will typically bend with the dynamic contact mechanics of polishing, an initial polish surface area will typically wear to conform to the bend angle. For example, an initial circular top surface will wear to form an angled top surface and the changes in direction experienced during polishing will create multiple wear patterns.

As shown in FIG. 2, polishing pad 104 includes polishing layer 202 and may include in addition a subpad 250. It is noted that subpad 250 is not required and polishing layer 202 may be secured directly, via base layer 240, to a platen of a polisher, e.g., platen 130 of FIG. 1. Polishing layer 202 may be secured, via base layer 240, to subpad 250 in any suitable manner, such as adhesive bonding, e.g., using a pressure sensitive adhesive layer 245 or hot-melt adhesive, heat bonding, chemical bonding, ultrasonic bonding, etc. The base layer 240 or subpad 250 may serve as the polishing base for attachment of the polishing elements 208. Preferably, a base portion of polishing elements 208 extends into base layer 240.

Various methods of manufacture are possible for polishing texture 200. For larger-scale networks, these include micromachining, laser or fluid-jet etching, and other methods of material removal from a starting solid mass; and focused laser polymerization, filament extrusion, fiber spinning, preferential optical curing, biological growth, and other methods of material construction within an initially empty volume. For smaller-scale networks, crystallization, seed polymerization, lithography or other techniques of preferential material deposition may be employed, as well as electrophoresis, phase nucleation, or other methods of establishing a template for subsequent material self-assembly.

Polishing elements 204 and 208 and base layer 240 of microstructure 200 may be made of any suitable material, such as polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and mixtures thereof. Polishing elements 204 and 208 and base layer 240 may also be made of a non-polymeric material such as ceramic, glass, metal, stone, wood, or a solid phase of a simple material such as ice. Polishing elements 204 and 208 and base layer 240 may also be made of a composite of a polymer with one or more non-polymeric materials.

In general, the choice of material for the polishing elements 204 and 208 and base layer 240 is limited by its suitability for polishing an article made of a particular material in a desired manner. Similarly, subpad 250 may be made of any suitable material, such as the materials mentioned above for the polishing elements 204 and 208. Polishing pad 104 may optionally include a fastener for securing the pad to a platen, e.g., platen 130 of FIG. 1, of a polisher. The fastener may be, e.g., an adhesive layer, such as a pressure sensitive adhesive layer 245, hot melt adhesive, a mechanical fastener, such as the hook or loop portion of a hook and loop fastener. It is also within the scope of the invention to implement one or more fiber-optic endpointing devices 270 or similar transmission devices that occupy one or more of the void spaces of polishing texture 200.

Figure 4:
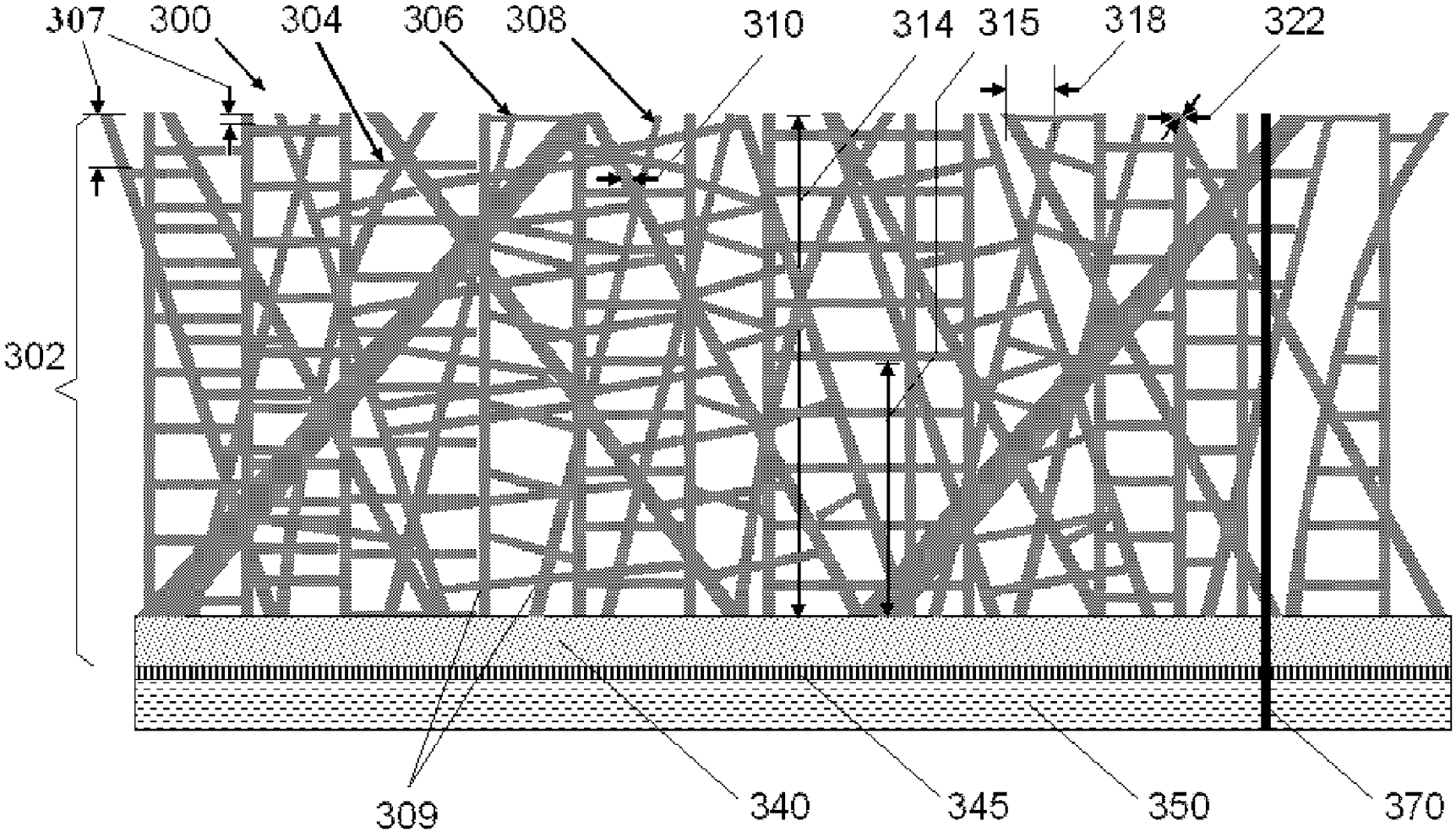
FIG. 4 is a highly enlarged, partial, schematic, cross-sectional, elevational view of a chemical mechanical polishing pad of one embodiment of the present invention.

The polishing texture 300 of FIG. 4 illustrates that the present invention comprehends open interconnected networks comprising elements positioned at all angles from fully horizontal to fully vertical. By extension, the invention comprehends an entirely random array of slender elements in which there is no clearly repeating size or shape to the void spaces within the polishing texture, or where many elements are highly curved, branched, or entangled. Familiar images that, as microstructures, would fall within the scope of the invention are bridge trusses, stick models of macromolecules, and interconnected human nerve cells. In each case the structure must possess the same critical features, namely that sufficient interconnection in three dimensions is present to stiffen the overall network, that a wearing of the network in a horizontal plane from the top surface produces slender elements having locally unbuttressed ends that provide compliance with a workpiece over short length scales, and that the length to width ratio of the elements conform to the geometric limits given previously.

With reference to FIG. 4, a second embodiment of polishing pad 104 of FIG. 1 consistent with the present invention is described with respect to an alternative surface polishing texture 300—a side cross-sectional view of FIG. 4 would have a similar asymmetrical pattern of interconnected reticulated unit cells within polishing layer 302. Similar to the pad of FIG. 2, adhesive layer 345 secures base layer 340 to optional subpad 350; and optionally includes endpointing device 370. Polishing texture 300 comprises elements 304 and 308. Polishing texture 300 differs from polishing texture 200 of FIG. 2 in at least two aspects. First, the elements 308 of polishing texture 300 are not strictly vertical but are positioned at a variety of angles between 45 and 90 degrees with respect to the base layer 340 and the horizontal plane, and a few of the elements 308 are curved rather than straight. Also, the interconnecting elements 304 are not all horizontal but some are positioned at angles of 0 to 45 degrees with respect to the base layer 340 and the horizontal plane. As such, polishing texture 300 consists of unit cells, but the cells vary in shape and number of faces. These features notwithstanding, height 314 of elements 308 does not vary substantially within polishing texture 300 between the polishing layer or polishing element 306 and the half height 315 of the polishing texture 300. Second, there is more variation in the width 310, pitch 318, and contact area (i.e., cross-sectional area in plane of polishing surface) 322 among elements 304 and 308 than in the corresponding attributes of polishing elements 208. Nonetheless, polishing texture 300 embodies the essential properties of the present invention where elements 306 form the polishing surface. In particular, the elements 304 and 308 interconnect at junctions 309 to form a network interconnected in three dimensions to a sufficient degree to impart stiffness to the polishing texture as a whole, while the unbuttressed ends of elements 308 provide local flexibility to conform to a workpiece.

In the embodiment shown in FIG. 4, the contact area ratio C is the average contact area 322 divided by the unit projected area equal to the square of the average pitch 318. Because pitch 318 and contact area 322 are highly variable, it is preferred to calculate C as an average over a larger area encompassing many contacting elements, in which case C is the ratio of the total of many contact areas 322 to the horizontal projected area of polishing texture 300 containing the contact areas 322. The non-contact area used in the ratio N is the sum of three contributions: (a) the vertical surface of each upright element 308 over the individual height 307 by which such element extends above the uppermost interconnecting element 304, (b) the vertical surfaces of contact elements 306, and (c) the top horizontal area and side vertical areas of the uppermost interconnecting elements 304. It will be recognized that these non-contact areas are collectively the areas that are presented to a liquid encountering polishing texture 300 from above.

Figure 5:
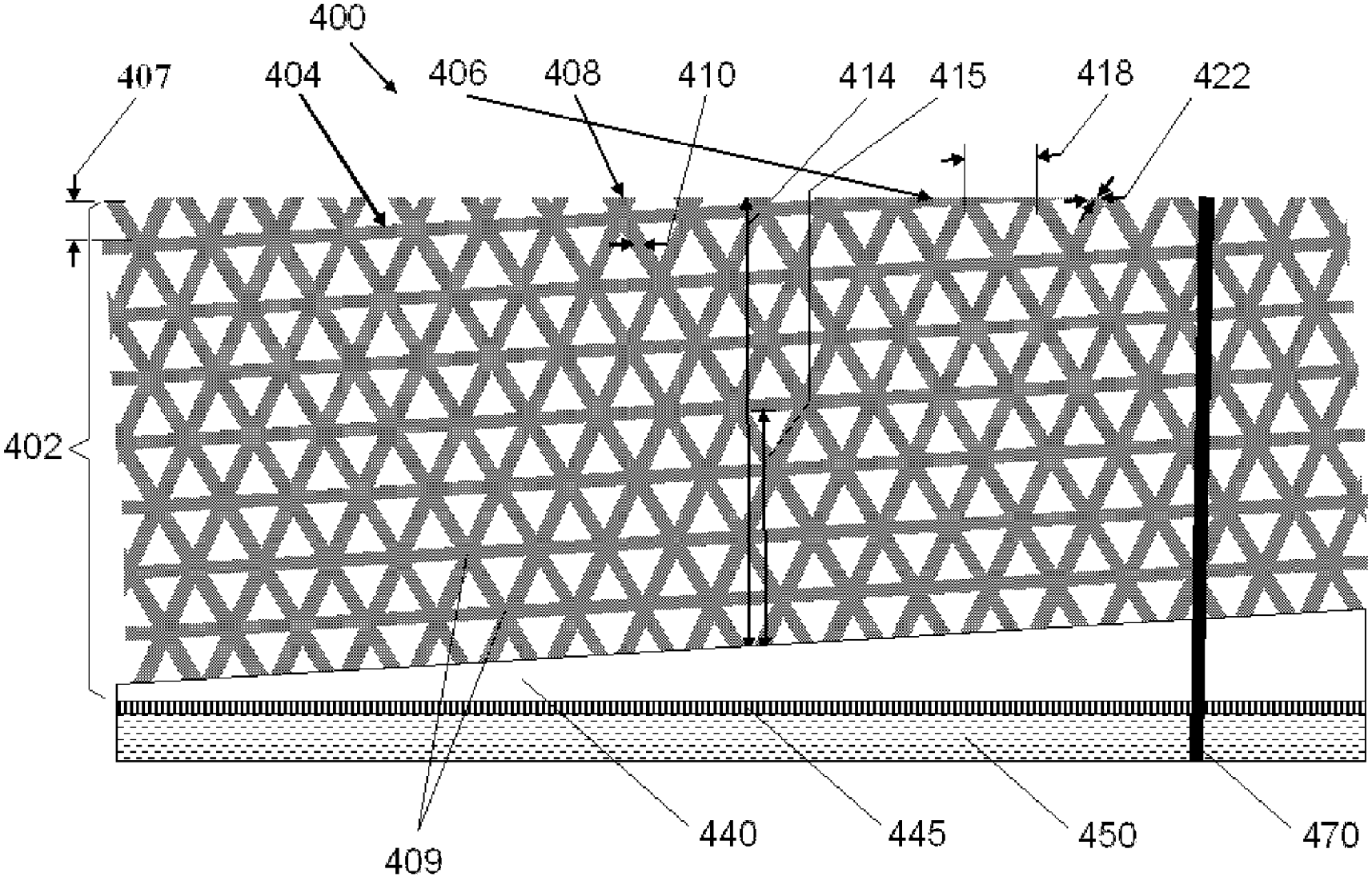
FIG. 5 is a highly enlarged, partial, schematic, cross-sectional, elevational, view of a chemical mechanical polishing pad of one embodiment of the present invention.

An additional embodiment of the invention is shown in FIG. 5 and consists of polishing layer 402 having regular-spaced interconnected tetrahedral lattice of elements 404 and 408. All elements 404 and 408 are shown as identical in length and width that join at junctions 409, though this need not be so. In the embodiment shown, the unit cell is a regular tetrahedron in which each (of four) faces is an equilateral triangle, the side of which is the pitch 418 of the network, and solid members having a width 410 run along only the four edges of the spatial unit, leaving the center of each triangular face and of the spatial unit as a whole empty. Because of the symmetry of the tetrahedral lattice, a side cross-sectional and plan view of FIG. 5 would form the same reticulated pattern. This polishing texture provides the highest possible stiffness because triangularly faceted polyhedra are non-deformable. As the structure wears, free ends are formed on elements 408 that provide local deformability and compliance to the workpiece. In the embodiment shown in FIG. 5, the tetrahedral network is constructed on a slightly wedge-shaped base layer 440 so that no planes of the network are positioned exactly parallel to the plane of contact with the wafer. At a given point in time only a subset of members 406 are wearing along their longest dimension, while most of the area of contact is provided by the contact areas (i.e., cross-sectional areas in plane of polishing surface) 422 of elements wearing across their shorter dimensions. This provides the feature that the contact area remains essentially invariant over the height 414 between the polishing layer or polishing element 406 and the half height 415 of the polishing texture 400. Optionally, base layer 440 is stepped such that a repeating series of wedge-shaped sections supports the network. The structure shown in FIG. 5 is approximately one repeating unit. Similar to the pad of FIG. 2, adhesive layer 445 secures base layer 440 to optional subpad 450; and optionally includes endpointing device 470.

In the embodiment shown in FIG. 5, the contact area ratio C is the average contact area 422 divided by the unit projected area equal to 0.433 times the square of the pitch 418, that is, the area of an equilateral triangle having a side equal to pitch 418. The non-contact area used in the ratio N is the sum of three contributions: (a) the vertical surface of each upright element 408 over the individual height 407 by which such element extends above the uppermost interconnecting element 404, (b) the vertical surfaces of contact elements 406, and (c) the top horizontal area and side vertical areas of the uppermost interconnecting elements 404. It will be recognized that these non-contact areas are collectively the areas that are presented to a liquid encountering polishing texture 400 from above.

Figure 6:
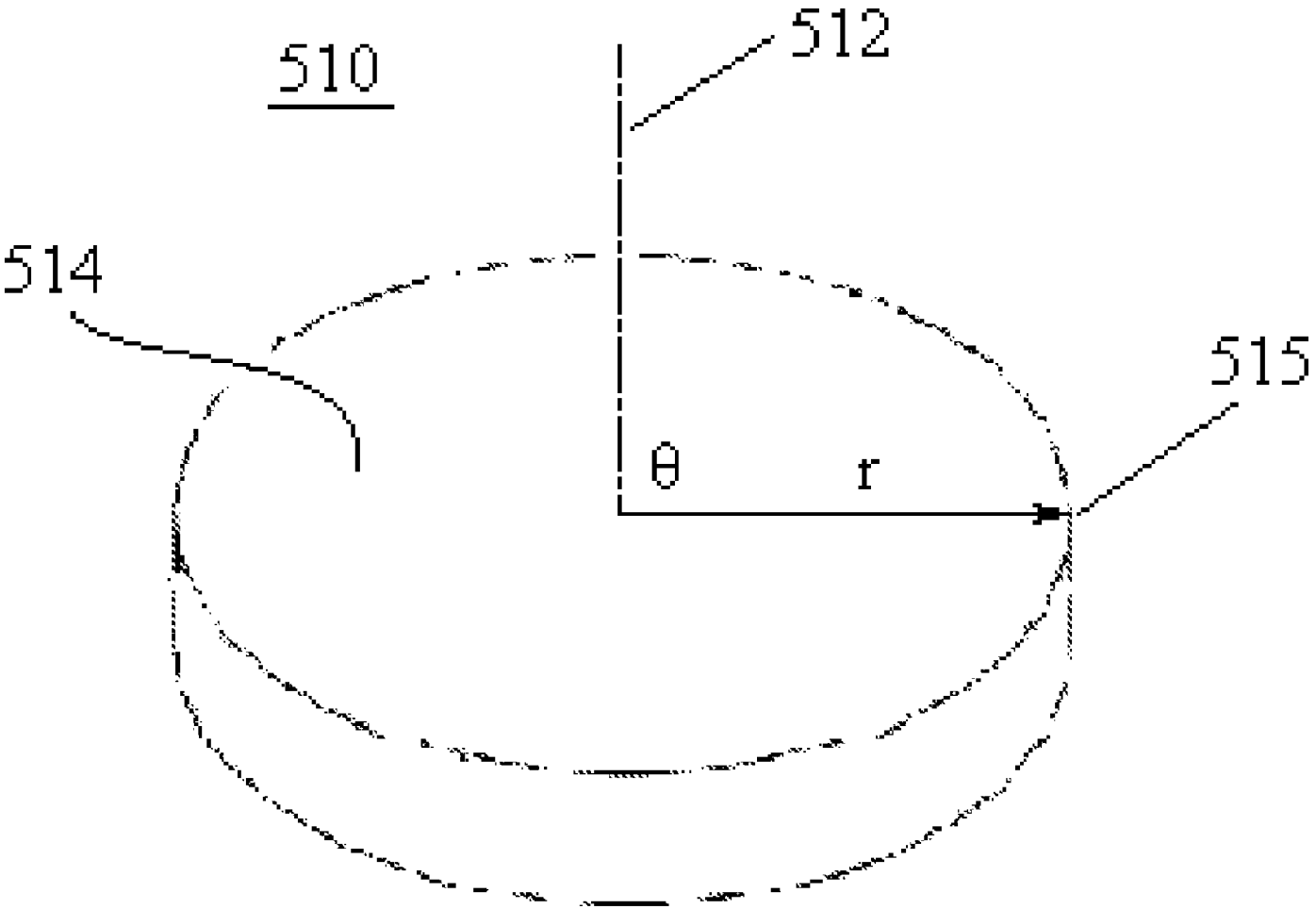
FIG. 6 is a side perspective view of a chemical mechanical polishing pad of one embodiment of the present invention.

In some embodiments of the present invention, the chemical mechanical polishing pad has a central axis and is adapted for rotation about the central axis. For example, FIG. 6 provides a side perspective view of a chemical mechanical polishing pad of one embodiment of the present invention. In particular, FIG. 6 depicts a single layer chemical mechanical polishing pad 510. The chemical mechanical polishing pad 510 has a polishing surface 514 and a central axis 512. The polishing surface 514 has a substantially circular cross section with a radius r from the central axis 512 to the outer periphery of the polishing surface 515 in a plane at an angle θ to the central axis 512. In some aspects of these embodiments, the polishing pad 510 is in a plane substantially perpendicular to the central axis 512. In some aspects of these embodiments, the polishing pad 510 is in a plane that is at an angle, θ, of 80 to 100° to the central axis 512. In some aspects of these embodiments, the polishing pad 510 is in a plane that is at an angle, θ, of 85 to 95° to the central axis 512. In some aspects of these embodiments, the polishing pad 510 is in a plane that is at an angle, θ, of 89 to 91° to the central axis 512. In some aspects of these embodiments, the polishing pad 510 has a polishing surface 514 that has a substantially circular cross section perpendicular to the central axis 512. In some aspects of these embodiments, the radius, r, of the cross section of the polishing surface 514 perpendicular to the central axis 512 varies by ≦20% for the cross section. In some aspects of these embodiments, the radius, r, of the cross section of the polishing surface 514 perpendicular to the central axis 512 varies by ≦10% for the cross section.

In FIG. 6 there is provided a side perspective view of a chemical mechanical polishing pad of one embodiment of the present invention. In particular, FIG. 6 depicts a single layer chemical mechanical polishing pad 510. The chemical mechanical polishing pad 510 has a polishing surface 514 and a central axis 512. The polishing surface 514 has a substantially circular cross section with a radius r from the central axis 512 to the outer periphery of the polishing surface 515 in a plane at an angle θ to the central axis 512.

We claim:

1. A chemical mechanical polishing pad for polishing a substrate selected from at least one of a magnetic substrate, an optical substrate and a semiconductor substrate; comprising:

a polishing layer comprising a plurality of polishing elements forming a three-dimensional reticulated network having a polishing texture;

wherein the polishing texture comprises a plurality of contact areas on a subset of the polishing elements;

wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area;

wherein the average dimensionless roughness of the polishing texture is between 0.01 and 0.75; and, wherein the polishing texture is adapted for polishing the substrate.

2. The chemical mechanical polishing pad of claim 1, wherein 90% of the subset of polishing elements having contact areas exhibit a contact area that is within ±10% of the average contact area.

3. The chemical mechanical polishing pad of claim 1, wherein 90% of the subset of polishing elements having contact areas exhibit a pitch with an adjacent polishing element having a contact area that is within ±10% of the average pitch.

4. The chemical mechanical polishing pad of claim 1, wherein 90% of the subset of polishing elements having contact areas exhibit a contact area that is within ±10% of the average contact area; and wherein 90% of the subset of polishing elements having contact areas exhibit a pitch with an adjacent polishing element having a contact area that is within ±10% of the average pitch.

5. The chemical mechanical polishing pad of claim 1, wherein the average dimensionless roughness, R, of the polishing texture is between 0.03 and 0.50.

6. The chemical mechanical polishing pad of claim 1, wherein the contact areas are selected from square cross-sections, rectangular cross-sections, rhomboid cross-sections, triangular cross-sections, circular cross-sections, ovoid cross-sections, hexagonal cross-sections, polygonal cross-sections, and irregular cross-sections.

7. The chemical mechanical polishing pad of claim 1, wherein the reticulated network has a plurality of unit cells, wherein the plurality of unit cells have an average width and an average length, and wherein the average width of the unit cells is ≦ the average length of the unit cells.

8. A method for polishing a substrate, comprising:

providing a substrate selected from at least one of a magnetic substrate, an optical substrate and a semiconductor substrate;

providing a chemical mechanical polishing pad having a polishing layer comprising a plurality of polishing elements forming a three-dimensional reticulated network having a polishing texture; wherein the polishing texture comprises a plurality of contact areas on the polishing elements; wherein the polishing texture has an average dimensionless roughness, R, defined by the following equation:

$$R=(1-C)/(1+N)$$

where C is a ratio of the average contact area of the plurality of contact areas to an average horizontal projected area for the subset of the polishing elements and N is a ratio of an average non-contact area for the subset of the polishing elements to the average horizontal projected area;

creating dynamic contact at the interface between the chemical mechanical polishing pad and the substrate.

9. The method of claim 8 further comprising:

providing a polishing medium at an interface between the polishing texture and the substrate.

10. The method of claim 9 wherein the polishing medium permeates less than 10% of the height of the polishing layer.

* * * * *